US008986500B2

(12) United States Patent
Samuelsson et al.

(10) Patent No.: US 8,986,500 B2
(45) Date of Patent: Mar. 24, 2015

(54) ARRANGEMENT AND METHOD FOR THE CONTINUOUS STEAM PRE-TREATMENT OF CHIPS DURING THE PRODUCTION OF CELLULOSE PULP

(75) Inventors: Anders Samuelsson, Hammaro (SE); Jonas Saetherasen, Hammaro (SE); Krister Olsson, Karlstad (SE)

(73) Assignee: Valmet Aktiebolag, Sundsvall (SE)

( * ) Notice: Subject to any disclaimer, the term of this patent is extended or adjusted under 35 U.S.C. 154(b) by 221 days.

(21) Appl. No.: 13/201,144

(22) PCT Filed: Feb. 17, 2009

(86) PCT No.: PCT/SE2009/000090

§ 371 (c)(1),
(2), (4) Date: Nov. 3, 2011

(87) PCT Pub. No.: WO2010/095982

PCT Pub. Date: Aug. 26, 2010

(65) Prior Publication Data

US 2012/0111513 A1 May 10, 2012

(51) Int. Cl.
*D21C 1/02* (2006.01)
*D21C 7/06* (2006.01)
*D21C 7/08* (2006.01)

(52) U.S. Cl.
CPC .. *D21C 1/02* (2013.01); *D21C 7/06* (2013.01); *D21C 7/08* (2013.01)
USPC ..... 162/68

(58) Field of Classification Search
CPC ..... D21C 7/02; D21C 7/12; D21C 7/06; D21C 7/08
USPC ..... 162/246
See application file for complete search history.

(56) References Cited

U.S. PATENT DOCUMENTS

| | | | | |
|---|---|---|---|---|
| 5,714,043 | A | 2/1998 | Finley | |
| 2005/0061464 | A1 * | 3/2005 | Snekkenes | 162/242 |
| 2006/0213629 | A1 * | 9/2006 | Snekkenes et al. | 162/17 |
| 2009/0139671 | A1 * | 6/2009 | Karlsson et al. | 162/61 |
| 2009/0301673 | A1 * | 12/2009 | Snekkenes et al. | 162/49 |

FOREIGN PATENT DOCUMENTS

| | | |
|---|---|---|
| SE | WO02090648 | 11/2002 |
| SE | 530725 | 8/2008 |
| SE | 530725 C2 * | 8/2008 |

OTHER PUBLICATIONS

Google machine translation of SE 530,725 date Aug. 2008 performed on Jun. 11, 2013.*

* cited by examiner

*Primary Examiner* — Anthony Calandra
(74) *Attorney, Agent, or Firm* — Rolf Fasth; Fasth Law Offices

(57) ABSTRACT

The arrangement and method for the steam pre-treatment of chips during the production of cellulose pulp avoids the blow-through of gases in the steam pre-treatment vessel. This prevents foul-smelling gases from being released into the atmosphere. The inlet of the vessel has an inclined feeder device in a feeder-housing. In the event of the initiation of the risk for blow-through of steam, the feeder housing is sprayed with cooling liquid in order to increase condensation capacity of the chips being fed into the vessel. Ultimately the feeder housing is filled with liquid that establishes a liquid lock, and preferably at the same time as the feeder drive (M) is shut off. This avoids the emission of gases from the chip bin when interruptions in the process occur so that the release of odors into the surroundings is minimized.

8 Claims, 2 Drawing Sheets

ARRANGEMENT AND METHOD FOR THE CONTINUOUS STEAM PRE-TREATMENT OF CHIPS DURING THE PRODUCTION OF CELLULOSE PULP

PRIOR APPLICATION

This application is a U.S. national phase application based on International Application No. PCT/SE2009/000090, filed 17 Feb. 2009.

TECHNICAL AREA

The present invention concerns an arrangement and a method for the continuous steam pre-treatment of chips during the production of cellulose pulp.

BACKGROUND AND SUMMARY OF THE INVENTION

It is generally desired in association with the production of cellulose pulp from chips to first pre-treat the chips with steam such that air can be expelled. If this is carried out in a satisfactory manner, a homogenous impregnation of the chips is facilitated, and this gives a better and more even quality of pulp and a lower reject quantity. It is also possible to achieve a better transit of the column of chips through a continuous digester if all air has been expelled. In certain older conventional systems, chip bins at atmospheric pressure have been used, in which the chips are pre-heated with steam in order to expel the air. Very large volumes of expelled air are obtained from these systems, and this air is contaminated with turpentine, methanol and other explosive gases. If steam is used that has been obtained from the release of pressure from black liquor, this steam contains also large quantities of sulphides known as "TRS gases" (where "TRS" is an abbreviation for "total reduced sulphur"). These sulphides are very foul-smelling. These TRS gases contain, among other compounds, hydrogen sulphide ($H_2S$), methyl mercaptan ($CH_3SH$), dimethyl sulphide ($CH_3SCH_3$), dimethyl disulphide ($CH_3SSCH_3$), and other gases that are strongly foul-smelling or explosive. Hydrogen sulphide and methyl mercaptan arise to a major degree from the vaporisation of black liquor, and the boiling points of these are −60° C. and +6° C., respectively. This means that it is difficult to separate them from the gases by condensation.

The gases that do not lend themselves to easy removal by condensation are known as "NCGs" (where "NCG" is an abbreviation for "non-condensable gas"). Pure steam is often used for heating in the chip bin in order to minimise the release of TRS gases, and the black liquor steam is used first in a pressurised steam pre-treatment vessel that is located after the chip bin. Even if the black liquor steam is used solely in a subsequent pressurised steam pre-treatment vessel, these TRS gases can leak up to the chip bin, for example, during interruptions in operation. The use of pure steam for the steam pre-treatment, however, is expensive since the amount of steam available for the production of electricity at the pulp mill is in this case reduced.

Steam is driven through the complete bed of chips in certain steam pre-treatment systems, and this means that large volumes of dilute weak gases are obtained that must be managed in what are known as "weak gas systems". These steam pre-treatment systems are often known as "blow-through" systems, where the temperature in the uppermost surface of the bed of chips, or in the gas phase above the chips, or at both of these locations, is considerably higher than the ambient temperature, normally around 60-100° C. One major disadvantage of these systems is that a major fraction of the steam energy that is supplied is expelled with the expelled gases. These gases are condensed in weak gas systems with the result that large amounts of low-grade warm water are obtained, which often is passed to the drainage system, leading to large losses of energy.

The prior art technology has identified the problem as being that of desiring to minimise the leakage of harmful or toxic gases that arise during the steam pre-treatment using hot steam. There is normally a transfer of weak gases from the chip bin to a destruction system, and a further release transfer of gases from the steam pre-treatment vessel, the latter gases being often regarded as strong gases. It is normally attempted to maintain the concentration of the weak gases to a value well under 4% by volume, and that of the strong gases to well above 40% by volume, as concentrations there between becomes highly explosive. In known chip bins in which steam is blown into the bed of chips, large amounts of gases are generated, and either pure steam or special systems that can deal with these gases are required. Expelled gases may easily acquire a very explosive composition. There is no risk of explosion as long as the concentration of the gases lies under approximately 4% by volume or well over 40% by volume. For this reason, either weak gas systems that maintain a concentration of under 4% by volume, typically 1-2% by volume, or strong gas systems that maintain a concentration of well over 40% by volume are used. Thus, it is ensured in weak gas systems that the concentration is held well under 4% by volume, and this entails the transport of large amounts of air. As soon as the amount of gases is to increase, a corresponding increase in the amount of air must be carried out in order to maintain the concentration under the critical level.

If, for example, 1 kg/min of NCGs is created by steam pre-treatment in a chip bin, the amount of air must lie at around 50 kg/min in order to maintain a concentration of approximately 2% by volume. If the amount of NCGs were to increase to 2 or 3 kg/min, as may occur in the event of certain disturbances in the process, the amount of air must temporarily be increased to 100 or 150 kg/min, respectively. This results in the systems normally being dimensioned such that they can deal with the normal flow, while excess gases that arise during interruptions in operation are expelled directly to the atmosphere through vent pipes.

A further solution for minimising the volumes of weak gases is to control the flow of chips through the chip bin such that a stable plug flow through the chip bin is established, and where the addition of steam to the chip bin takes place in a controlled manner such that only the chips in the lower part of the bin are heated to 100° C., while the temperature in the gas phase above the chips level that is established in the steam pre-treatment bin essentially corresponds to the ambient temperature.

This technique is known as "cold-top" control and it is used in chip bins that are marketed by Metso Paper under the name of DUALSTEAM™ bins, and that are used in impregnation vessels that are marketed under the name of IMPBIN™. The major advantage of these systems is that they implement heating in an efficient manner, in which all of the supplied heat is absorbed into the process. This is in contrast to heating in which the steam is allowed to blow through the upper surface of the bed of chips and where the vented steam must be condensed, giving large losses of energy. A further advantage of "cold-top" control is that a further process location is not established in at which extraction of turpentines from the chips can take place, and for this reason essentially all turpentine instead accompanies the black liquor that is with-drawn from the digestion process. The pressure of this black liquor can then be released in a conventional manner in a flash tank or in the evaporation process.

Yet another advantage with "cold top" heating is that no escape of methyl mercaptan ($CH_3SH$) is at hand, and these compounds stay in the process. In FI 118347 has the Central laboratory (Keskuslaboratorio/KCL) at Åbo University patented a process where a PS-cooking process is improved by the presence of organic mercaptans, in order to increase the sulfidity during the PS-cook and as a consequence increase delignification speed to that of the conventional kraft process. This finding supports the process advantages with the "cold top" control, and prevention of escape of the mercaptans.

A number of very expensive solutions have been developed in order to reduce the explosiveness and toxicity of the gases. WO 96/32531 and U.S. Pat. No. 6,176,971, for example, reveal different systems in which digester liquor drawn off from the digester generates pure steam from normal water. The TRS content of the weak gases is reduced by using totally pure steam for the steam pre-treatment of the chips, since the steam used is totally free of any TRS content. These systems, however, inevitably give rise to loss of energy and more expensive process equipment.

SE 518789 (=U.S. Pat. No. 7,229,524) disclose a system for minimizing the amount of weak gases expelled from a chip bin, preferably with cold-top control. Here is a water lock established permanently in the inlet of the steaming vessel and the chips are forced trough this water lock in steady state operations. This solution reduces the amount of air brought into the chip bin together with in feed of chips to a practical minimum. However, forcing untreated chips trough a water lock is problematic, especially when feeding softwood chips having less density than hardwood, especially eucalyptus. The availability of the system could be reduced due to this buoyancy problem of the chips, especially when handling softwood such as fir or pine.

SE 528116 (WO2007064296) reveals an embodiment for the handling of the weak gases that are expelled from a chip bin with cold-top control. Air is in this case added to the weak gas system at an amount that is proportional to the degree of blow-through, such that the weak gases remain at all times on the dilute side of the region of concentration at which they become explosive. A gas washing operation is here included in the weak gas system.

The steam treatment of chips in the prior art technology has had the principal aim of expelling air from the chips, and the possibility of using cooling fluids directly in the steam treatment has for this reason not been considered. The cooling technique has been used exclusively in the subsequent weak gas system, which is independent of the steam pre-treatment vessel, where the gases have been cooled or condensed. It has, however, proved to be the case that the use of cooling fluids during the steam treatment is very efficient, and that relatively small amounts of cooling fluid are required in order to eliminate problems with odour. Since disturbances in the system occur sporadically, it is simple to avoid the dilution effects in the weak gas systems described above, with the use of direct cooling.

In SE530727 is shown an improvement of the "cold top" control of steaming in a chip steaming vessel marketed as Metso IMPBIN™. Here are a number of shower nozzles been installed in the top of the chip steaming vessel, and these showers are activated when a blow-trough condition is possible. If these showers are activated such that the blow-trough could be prevented, then no escape of steam or NCG-gases would occur. However, if a blow-trough anyway may be at hand, especially if the chip pile volume is very low, could steam and NCG gases escape trough the inlet of the chip steaming vessel.

A first aim of the invention is to make the steam pre-treatment process safer such that the risks for steam and NCG gases escaping trough the inlet of the chip steaming vessel is reduced to a minimum, and this in turn ensures that the release of foul-smelling gases to the surroundings can be kept to a minimum.

A second aim is to ensure a perfect lock in the chip steaming vessel, which could be activated only when there is an imminent risk for steam and NCG gases escaping trough the inlet of the chip steaming vessel. In steady state operation of the chip steaming vessel could the inlet feed be operated without any restrictions in the inlet feed of preferably untreated chips, which chips otherwise have less density than process liquids used and thus floats. This results in higher availability of the system.

A third aim is that the safety system should preferably be used during what is known as "cold-top" control during steam pre-treatment of the chips, where the chips are heated such that a temperature gradient is formed in the volume of chips, where the chips at the top of the chip bin have the ambient temperature, typically around 0-50° C., preferably 20-40° C., and a gradually higher temperature is established down towards the bottom of the chip bin, with an advantageous temperature of approximately 90-110° C. established at the bottom of the chip bin. This system has the result that the volumes of weak gases that are expelled from the chips in the chip bin are very low, and the load on the weak gas system will be minimal during continuous equilibrium operation. These weak gases, mostly coming from the in feed of air between preferably untreated chips, have a concentration which lies well below the explosive concentration range. One property of the system, however, is that expelled gases from the bottom of the chip pile tend to condense in a condensation layer within the volume of chips. If a blow trough condition is at hand could this concentrated condensation layer be released into the upper part of the chip bin. If such condensate layer is released, the concentration of gases in the top of the chip treatment vessel shifts from weak to strong gases, and passes the explosive concentration range. It is of importance from safety point of view that explosive gases do not leak trough the inlet and expose the workforce for risks for explosions.

A fourth aim is to minimise the effects of a blow-through, should such occur, by providing a leak proof liquid look in the inlet which prevents any strong smelling mercaptans from escaping trough the inlet. These mercaptans are extremely smelling, and it requires only parts of ppm in gas leakage in order to spread odours miles around a mill site.

DETAILED DESCRIPTION

Figure 1:
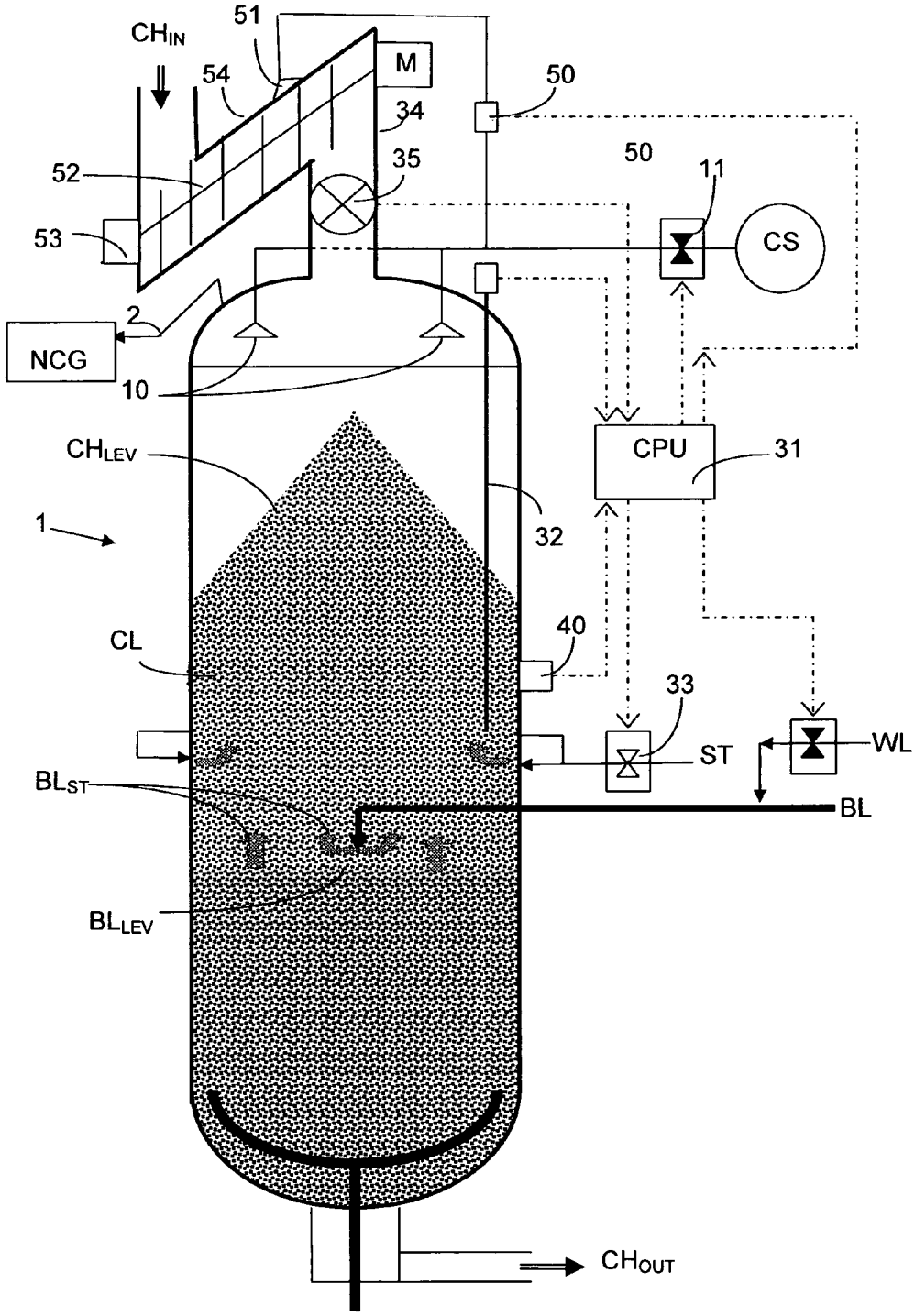
FIG. 1 shows schematically an arrangement according to the invention for the steam pre-treatment of chips.
Figure 2:
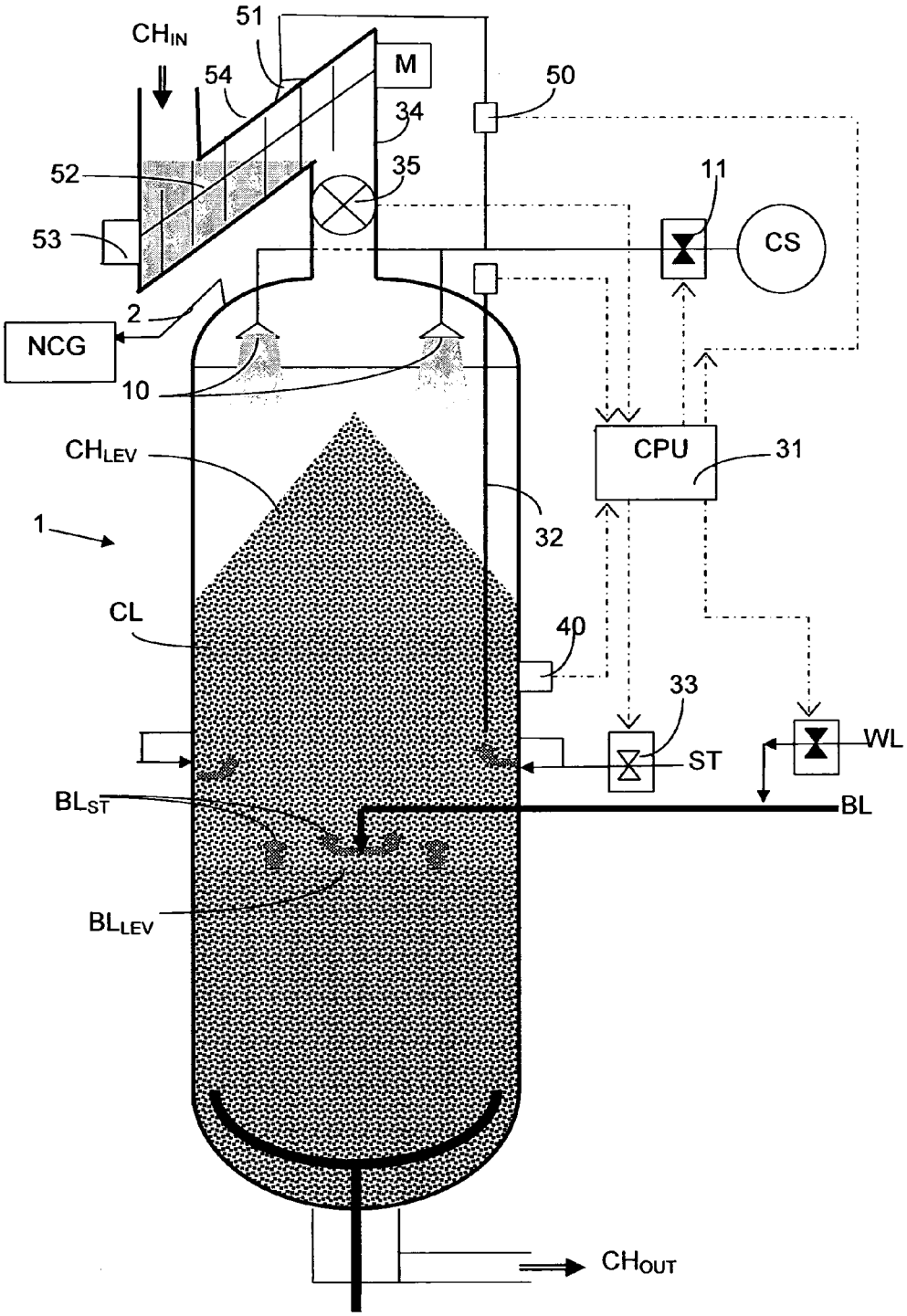
FIG. 2 shows schematically the arrangement in FIG. 1 with liquid filled inlet screw.

FIG. 1 shows schematically a suitable vessel, shown here as an impregnation vessel 1, into which chopped chips $CH_{IN}$ are fed through a flow regulator or sluice feed 35, at the top of the impregnation vessel. This type of impregnation vessel corresponds to that which is marketed by Metso Paper under the name IMPBIN™.

The concept of "steam pre-treatment vessel" will be used below, which concept includes not only chip bins with steam pre-treatment of the DUALSTEAM™ type, but also impregnation vessel of the IMPBIN™ type with integrated steam pre-treatment. The major difference between chip bins with steam pre-treatment and impregnation vessels with steam pre-treatment is that the impregnation in the latter case takes place using impregnation fluid, typically black liquor, at the bottom of the impregnation vessel, and this black liquor is sufficiently hot when it is added to the impregnation vessel to generate steam. The amount of pure steam that is required for complete steam pre-treatment can in this way be reduced.

An upper level of chips $CH_{LEV}$ is normally established at the top of the steam pre-treatment vessel, where the feed is controlled in such a manner that this level is established between a lowermost and an uppermost level. A gas phase is established in the vessel between this upper chips level and the top of the vessel.

The steam pre-treatment vessel shown in FIG. 1 is a vessel in which impregnation of chips takes place in the lower part of the vessel, as is shown in the drawing. This may take place, for example, according to a technique that is sold by Metso Paper under the name IMPBIN™. Pressurised hot black liquor, BL, is preferably added to the vessel via a central pipe having an outlet some distance above the liquid level $BL_{LEV}$, whereby the pressure on this hot black liquor is released and generates the principal fraction of the steam that is required for the steam pre-treatment of the chips. The steam that is expelled from the outlet of the central pipe and the surface $BL_{LEV}$ of the black liquor is indicated with $BL_{ST}$.

Steam ST may optionally be added also at the lower parts of the steam pre-treatment vessel through suitable outlet or addition nozzles, well under the upper chips level that has been established, where the amount of steam is regulated following detection of the temperature in the column of chips. A measurement probe 32 is shown in the drawing, which probe establishes a mean value along a long stretch of the probe, and the output signal from the probe is led to a control unit 31 that regulates valves 33 in the steam supply line.

The steam may be, preferably, pure steam that is totally devoid of NCGs and TRS gases, or it may be black liquor steam with a certain content of TRS gases.

The steam that is required for the steam pre-treatment is thus obtained from a suitable steam generation means, primarily in the form of hot black liquor that generates steam in the bed of chips when its pressure is released or an optional direct addition of steam (which may be either pure steam or steam that contains TRS gases). The steam generation means may also be both of these two sources.

The chips are pre-treated with steam in the embodiment that is shown according to the cold-top concept, where it is attempted to establish a temperature gradient within the chip bin. The chips in the upper surface of the column of chips should, ideally, maintain the ambient temperature, typically in the region between 0 and 50° C., and preferably between 20 and 40° C. One effect of the cold-top control is that a layer CL of condensate forms in the column of chips, at which a high fraction of NCGs and TRS gases collects. It is possible to retain this layer of condensate at a safe depth far down in the volume of chips, and prevent the expulsion upwards of these gases, provided that the upper surface of the column of chips is held at a low temperature.

A ventilation channel 2 is arranged at the upper part of the vessel for removal of the weak gases that are formed. This ventilation channel 2 is coupled to a weak gas system NCG to which the weak gases are evacuated for destruction.

Means 10 for the direct injection of cooling fluid from a source CS of cooling fluid are present, according to the invention, and these means are arranged at the top of the steam pre-treatment vessel. Furthermore, at least one regulator valve 11 is arranged in the connecting line between the source CS of cooling fluid and the injection means 10. The control unit 31 is arranged to open the regulator valve 11 through activation means, and activate the cooling when at least one detected operational parameter indicates that blow-through is taking place.

At least one spreader nozzle 10 is arranged at an outlet from the injection means, which spreader nozzle is preferably a high-pressure nozzle that spreads a finely divided cooling fluid into the top of the steam pre-treatment vessel. In order to condense gases in the gas phase, it is advantageous if the cooling fluid is injected as finely divided drops or a finely divided mist, which increases the area of contact between the gas phase and the cooling fluid. It is preferable that the pressure in the cooling fluid is maintained at a level that corresponds to an excess pressure of at least 3 bars relative to the pressure at the top of the steam pre-treatment vessel.

It is appropriate that a number of spreader nozzles are arranged at the top of the steam pre-treatment vessel, and that they are located such that they cover the complete flow cross-section of the steam pre-treatment vessel during the injection of cooling fluid. For a steam pre-treatment vessel with a diameter of 3-8 meters, it is possible to arrange four spreader nozzles evenly distributed around the circumference, with 90 degrees between neighbouring spreaders, with these spreader nozzles located at a distance from the centre of the vessel that corresponds to 40-60% of the radius of the vessel.

For a steam pre-treatment vessel with a diameter of 8-10 meters, it is possible to arrange 6-8 spreader nozzles evenly distributed around the circumference, with 60 or 45 degrees, respectively, between neighbouring spreaders, with these spreader nozzles located at a distance from the centre of the vessel that corresponds to 40-60% of the radius of the vessel.

According to the invention is the chip inlet 34 comprising a preceding inclined feeder device 52 in a feeder housing 54 having an upper end of said housing connected to the chip inlet 34 and a lower end connected to the infeed of chips $CH_{IN}$, and wherein the highest point of said lower end is at or below the lowest point of said upper end. The in feed of chips $CH_{IN}$ is thus made trough a first generally vertical pipe, which is connected to an inclined pipe section of the feeder housing that is directed upwardly, and which upper end of the inclined pipe section is connected to a second generally vertical pipe connected to the chip inlet 34, thus forming an Z-shaped pipe section, but rotated 90 degrees, and reassembling a water lock shape.

The feeder device 52 having a feeder drive M. In this embodiment is the feeder device 52 a feeder screw, but it could equally well be another type of feeding arrangement inside the inclined feeder housing, such as a chain drive or equivalent means.

The sluice feeder 35 could be the flow control of in feed of chips, but the order of chips into the vessel could also optional be measured by the screw feeder, and thus the sluice feeder be omitted.

Preferably the same a control unit 31 as that used for the activation of the showers 10 could be arranged such that it detects through detection means 32 at least one operational parameter that is indicative of the blow-through of steam up through the bed of chips when the low temperature at the upper surface of the bed of chips exceeds a threshold value. In parallel with the showers 10 is also means 51 for the injection of cooling fluid from the source CS of cooling fluid arranged at the inclined feeder housing 54. At least one regulator valve 11 is arranged in the connecting line between the source CS of cooling fluid and the injection means 10. The control unit 31 is arranged to open the regulator valve 11 through activation means when the operational parameter that has been detected indicates that blow-through is taking place, thus activating the injector 51 and preferably also the showers 10.

In a preferred embodiment could a control device 50 activates the means 51 for the injection of cooling fluid for a predetermined time or until the inclined feeder housing is filled with cooling fluid via any appropriate level control in the feeder housing. This device 50 could in its simplest form be a stand-alone timer, or integrated in the control unit 31 with a separate activator signal sent to a valve instead of a timer 50.

The feeder housing 54 with its upper end of said housing connected to the chip inlet 34 and the lower end connected to the in feed of chips $CH_{IN}$, could preferably be designed in such a way that the a liquid filled housing could hold a predetermined overpressure in the steam pre-treatment vessel in the order of 0.01 to 0.5 bar (i.e. 0.1 to 5 meter of liquid level). The highest point of said lower end should accordingly be 0.1 to 5 meter below the lowest point of said upper end, thus establishing a liquid level in the inlet pipe of the chips at a corresponding order.

In yet a preferred embodiment could control device 50 also deactivate the feeder drive M at or after activation of the injection of cooling fluid. In a further embodiment could also the NCG system be shut off during filling of the feeder housing 54. After the treatment vessel has been sealed off, then the cooling effect, by activated showers 10, could be kept activated until the blow trough condition is counteracted. Of course could also complementary pressure relief valves be installed, in order to protect the treatment vessel from damaging pressure. However, the liquid lock is also a kind of primary pressure relief valve, as the liquid volume in the liquid lock only could hold an overpressure equal to the height of liquid in the liquid lock.

The number of spreader nozzles 10 arranged at the top of the steam pre-treatment vessel, could preferably be activated for injection of cooling fluid into the pre-treatment vessel at or before activation of the injection of cooling fluid into the feeder housing 54.

It is preferable that the system is activated during continuous steam pre-treatment of chips for the production of cellulose pulp, where preferably untreated chips that retain a temperature that corresponds to the ambient temperature are fed into a steam pre-treatment vessel in which the chips are to be treated with steam with the aim of pre-heating the chips and expelling air that is contained within the chips. The steam pre-treatment vessel has a chips inlet at the top and an outlet at the bottom and where steam is added to the bed of chips that has been established in the steam pre-treatment vessel through steam generation means. A temperature gradient is established in the bed of chips from a high temperature that has been established low down in the bed of chips to a low temperature that has been established at the upper surface of the bed of chips. When subsequently an operational condition indicates that there is a risk of the initiation of blow-through of steam up through the bed of chips, a cooling mode is initiated.

This cooling mode could in a first phase inject cooling fluid at the top of the steam pre-treatment vessel via the nozzles 10. This first phase could be sufficient in cooling down the chip pile. However, if a potential blow trough conditions still prevails, could also cooling liquid be injected into the feeder housing 54 via nozzle 51, in order to increase the condensation capacity of the chips being fed into the treatment vessel, or ultimately to fill the feeder housing. Preferably is also the drive M of the feeder device shut off during filling.

The risk of blow-through can be detected when, for example, the temperature in the bed of chips in association with its upper surface (or in the gas phase above the level of chips) exceeds a threshold value, whereby the injection is activated in one or several phases as described above.

The risk of blow-through can be detected also when, for example, the flow of chips either in to or out from the steam pre-treatment vessel falls below a threshold value, whereby the injection is activated.

Water or cooled process fluids from the production process for cellulose pulp is used as cooling fluid. These cooled process fluids may be cooled white liquor, cooled black liquor or cooled filtrate from a subsequent washing stage, etc.

The amount of cooling fluid that is injected is preferably controlled to be proportional to the degree of risk of blow-through, and this can take place through activating different numbers of injection nozzles, or by using a degree of opening of each activated injection nozzle that is modulated by the pulse-width.

In one simple form of regulation of the cooling, the activation of the cooling is controlled as a dependence on the temperature in the volume of chips, detected by the measurement probe 32 or by a temperature sensor arranged in the gas phase above the level of chips (not shown in the drawing). The control means 31 opens the valve 11 to a degree that is proportional to the excess of at least a first or a second threshold value, or proportional to the excess of one threshold value. The first threshold value may be a pre-determined first temperature $T_{LEV1}$ and the second threshold value may be a predetermined second temperature $T_{LEV2}$, where $T_{LEV1}<T_{LEV2}$.

The regulation of the flow of cooling fluid also preferably takes place in combination with the activation of other regulatory measures. The supply of steam may be stopped, for example, when the temperature becomes too high. The amount of cold chips that is fed in may also continues, or be allowed to establish a higher level when the temperature becomes too high.

When implementing the cooling in a steam pre-treatment vessel that has an integrated impregnation process at its bottom, the system can simply compensate for the dilution that may be the consequence of the injection of cooling fluid. More white liquor can, for example, be added into the black liquor with the aim of re-establishing the correct alkali concentration in the impregnation fluid. This is shown in the drawing by a valve that can be influenced by the control unit 31, located in a supply line for white liquor, WL, which connects to the line for the addition of black liquor, BL.

Examples of Degree of Activation of Cooling

A sub-fraction of the spreader nozzles 10 is activated in the event of the first threshold value being exceeded. The degree of opening may be modulated by pulse width, i.e. they may be opened, for example, for 20% of the time span of a period lasting 300 seconds.

The remaining spreader nozzles 10 may be activated with the same modulation of pulse width (20% of 300 seconds) in the event of a second threshold value being exceeded.

The degree of opening of the spreader nozzles may be increased, such that they are held open, for example, during pulse width modulation for 40% of the time span of a period lasting 300 seconds, in the event that a third threshold value is exceeded.

And the degree of opening can be increased at even higher temperatures, by 20% in steps, until all spreader nozzles are held continuously open.

It is an advantage if the cooling effect can be coupled in several stages, such that a sudden and rapid cooling effect is not introduced into a superheated gas phase, which may cause an uncontrolled and rapid fall in pressure, which may even lead to such a severe negative pressure in the steam pre-treatment vessel that it risks implosion.

It will be realised from this example of temperature-controlled activation of the cooling effect that also other control principles for the cooling may be implemented. The flows in to and out from the steam pre-treatment vessel, for example, may be monitored, and if the inflow of cold chips, for example, should cease or decrease, the risk that heat at the bottom of the vessel is transferred upwards increases. The same is true if the outflow of steam-treated chips should cease or decrease dramatically.

The system and the method may be supplemented also with measurement of the level of chips in the vessel, detected by a level detector 40, with also this signal of the level being fed to the control unit CPU. Gradually increasing amounts of cooling fluid can be added in the event of a gradually sinking level of chips, below a minimum level.

Each spreader nozzle can be provided with an individual regulator valve 11 for individual regulation.

The invention can be varied in a number of ways within the framework of the attached patent claims. The Liquid lock may or may not be combined with the cooling showers shown.

The shape of the feeder housing could also have any other shape than a Z-shape, as long as a liquid lock could be established in the feeder housing.

The feeder device could also be of any other design than a feeder screw, such as feeder chains, pocket feeder or any stoker (push-rod device).

The Liquid used in the liquid lock could also have additives capable of binding NCG-gases, and the liquid used in the liquid lock established in the inclined screw feeder could also be set in a continuous recirculation mode, flushing the chips in the feeder device.

While the present invention has been described in accordance with preferred compositions and embodiments, it is to be understood that certain substitutions and alterations may be made thereto without departing from the spirit and scope of the following claims.

The invention claimed is:

1. A method for the continuous steam pre-treatment of chips during the production of cellulose pulp, comprising:

providing a steam pre-treatment vessel having a chips inlet defined therein at a top of the vessel and an outlet defined therein at a bottom of the vessel, the chip inlet having an inclined feeder device in a feeder housing having a first end connected to the chip inlet and a second end connected to an in-feed device of chips ($CH_{IN}$), the feeder device having a feeder drive (M), providing untreated chips having a temperature corresponding to an ambient temperature, feeding the untreated chips to the steam pre-treatment vessel, pre-treating the chips with steam and expelling air contained in the chips, establishing a bed of chips in the steam pre-treatment vessel and adding steam (ST) to the bed of chips, establishing a temperature gradient in the bed of chips and establishing a high temperature low down in the bed of chips and a low temperature at an upper surface of the bed of chips, a sensor, disposed in the steam pre-treatment vessel, detecting an operational condition in the steam pre-treatment vessel that indicates a risk of an initiation of a blow-through of steam up through the bed of chips, and upon detection of the operational condition, injecting a cooling liquid into the feeder device to cool down the chips being fed into the pre-treatment vessel increasing a condensation capacity of the chips.

2. The method according to claim 1, wherein the step of injecting the cooling liquid is activated when the temperature in the upper surface of the bed of chips exceeds a threshold value.

3. The method according to claim 1, wherein the step of injecting the cooling liquid is activated when a flow of chips into or out from the steam pre-treatment vessel falls below a threshold value.

4. The method according to claim 1 wherein water or cooled process fluids from the production process for cellulose pulp is used as the cooling liquid.

5. The method according to claim 4, wherein the cooling liquid is injected as finely divided drops or a finely divided mist into the steam pre-treatment vessel.

6. The method according to claim 5, wherein the cooling liquid is also injected into the pre-treatment vessel via multiple injection nozzles.

7. The method according to claim 1 wherein the method further comprises the steps of filling up a portion of the feeder housing with the cooling liquid, and establishing a liquid lock in the feeder housing.

8. A method for the continuous steam pre-treatment of chips during the production of cellulose pulp, comprising:

providing a steam pre-treatment vessel having a chips inlet defined therein at a top of the vessel and an outlet defined therein at a bottom of the vessel, the chip inlet having a feeder device being connected thereto, providing untreated chips having a temperature corresponding to an ambient temperature, feeding the untreated chips to the steam pre-treatment vessel via the feeder device, pre-treating the chips with steam and expelling air contained in the chips, establishing a bed of chips in the steam pre-treatment vessel and adding steam (ST) to the bed of chips, establishing a temperature gradient in the bed of chips and establishing a high temperature low down in the bed of chips and a low temperature at an upper surface of the bed of chips, detecting an operational condition that indicates a risk of an initiation of a blow-through of steam up through the bed of chips, upon detection of the operational condition in the steam pre-treatment vessel, injecting a cooling liquid into the pre-treatment vessel, upon detection of the operational condition in the steam pre-treatment vessel, injecting the cooling liquid into the feeder device, filling up a portion of the feeder device with the cooling liquid, increasing a condensation capacity of the chips disposed in the feeder device, and establishing a liquid lock in the feeder device.

* * * * *